US007909273B2

(12) United States Patent
Andrews et al.

(10) Patent No.: US 7,909,273 B2
(45) Date of Patent: Mar. 22, 2011

(54) SHREDDER WITH GAS DETECTION SYSTEM

(75) Inventors: Brian A. Andrews, Roselle, IL (US); Michael D. Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 58 days.

(21) Appl. No.: 12/349,702

(22) Filed: Jan. 7, 2009

(65) Prior Publication Data

US 2010/0170968 A1 Jul. 8, 2010

(51) Int. Cl.
*B02C 25/00* (2006.01)

(52) U.S. Cl. ..... 241/30; 241/31; 241/36; 241/236; 241/101.3

(58) Field of Classification Search ..... 241/36, 241/31, 236, 100, 30
See application file for complete search history.

(56) References Cited

U.S. PATENT DOCUMENTS

| | | | | |
|---|---|---|---|---|
| 5,887,806 | A | 3/1999 | Onken | |
| 6,076,752 | A * | 6/2000 | Paradowski et al. | 241/16 |
| 6,663,029 | B2 * | 12/2003 | Takano et al. | 241/31 |
| 7,154,402 | B2 | 12/2006 | Dayoub | |

OTHER PUBLICATIONS

Product Information Sheet retrieved from Internet, Fenwal Protection Systems, "Waste Shredders Explosion Protection by Application", http://www.fenwalprotection.com/utcfs/Template/Pages./Template-540/0,8063,pageId+1164&sitl..., Dec. 16, 2008, 4 pages.

Product Information Specs from Cypress Semiconductor. Corporation, "PSoC® Mixed-Signal Array", Models CY8C21634, CY8C21534, CY8C21434, CY8C21334, and CY8C21234, Apr. 18, 2008, pp. 1-40.

Product Information Sheet from Alphasense Ltd., for CH-D3 Combustible Gas Pellistor, Retrieved from Internet at www.alphasense.com, Dec. 16, 2008, 2 pages.

Product Information Sheet from Figaro for "TGS 832—for the detection of Chlorofluorcarbons (CFC's)", Sep. 2002; 2 pages.

Product Information Sheet from National Semiconductor. Corporation for "LM35 Precision Centigrade Temperature Sensors", Nov. 2000; 13 pages.

Product Information Sheet and Spec from U.S. Sensor, Orange, CA for DO-35 Standard Glass Encapsulated Thermistors, retrieved from Internet Dec. 16, 2008, 2 pages.

Preventable Fire Stories website, Archive for the 'paper shredder' Category, found at url: <http://exactproductsinc.com/WordPress/?cat=37>, earliest posting dated Apr. 22, 2006.

* cited by examiner

*Primary Examiner* — Mark Rosenbaum
(74) *Attorney, Agent, or Firm* — Pillsbury Winthrop Shaw Pittman LLP

(57) ABSTRACT

A shredder is disclosed having a gas detection system. According to one embodiment, one or more sensors may be placed inside the housing of the shredder to detect the presence of gases, and in particular, flammable or combustible gases. If a gas is sprayed into the shredder, the sensor(s) will detect the gas and the shredder may be deactivated. In addition, an exhaust fan may also be activated to purge the gas from the housing. Further, one or more indicators may be provided to alert the user that the sensor has detected gas. For example, a visible signal and/or audible sound may be generated to alert the user that the sensor has detected a flammable or combustible gas.

20 Claims, 5 Drawing Sheets

SHREDDER WITH GAS DETECTION SYSTEM

FIELD

This application generally relates to shredders for destroying articles, such as paper documents, compact disks, etc, and in particular, having a gas detecting system.

BACKGROUND

Shredders are well-known devices for destroying articles, such as documents, CDs, floppy disks, etc. Further, users purchase shredders to destroy sensitive articles, such as credit card statements with account information, documents containing company trade secrets, etc.

Contrary to warnings labels and instruction manuals, some users spray aerosols, such as WD-40® spray, into the cutting mechanism to lubricate the cutters. In addition, users may spray compressed gas into the shredder to remove debris from the cutters or optical sensor. However, the propellants and/or solvents in many aerosols and sprays may include combustible or flammable gases (or volatile compounds) which could be ignited by the normal electrical activity of the paper shredder. This poses a safety hazard for the user and may cause damage to the shredder.

SUMMARY

According to one embodiment, a shredder is provided comprising: a housing including a shredder mechanism configured to shred an article, the shredder mechanism comprising an electrically powered motor; a combustible gas detection system positioned inside the housing and configured to detect a combustible gas within the housing; and a controller coupled to the combustible detection system and configured to deactivate the motor of the shredder mechanism in response to the combustible gas detection system detecting the combustible gas within the housing.

According to another embodiment, a method for shredding is provided comprising: shredding an article using a shredder mechanism having an electrically powered motor; detecting, with a gas sensor, a combustible gas in the vicinity of the shredder mechanism; and deactivating the motor of the shredder mechanism upon detecting the combustible gas.

Other features of one or more embodiments of this disclosure will seem apparent from the following detailed description, and accompanying drawings, and the appended claims.

BRIEF DESCRIPTION OF THE DRAWINGS

Embodiments of the present disclosure will now be disclosed, by way of example only, with reference to the accompanying schematic drawings in which corresponding reference symbols indicate corresponding parts, in which.

DETAILED DESCRIPTION

According to one aspect of the application, a shredder including a gas detection system may be provided. The gas detection system may include one or more sensors placed inside the housing of the shredder to detect the presence of gas, and in particular, flammable and/or combustible gases. If a gas is sprayed into the shredder, the sensor(s) will detect the gas and the shredder motor may be deactivated. In addition, a fan may also be activated to exhaust gas from the housing and/or to draw in ambient air to dilute gas within the housing. Further, an indicator may be provided to alert the user that the sensor has detected a gas. For example, a visible indication and/or audible sound may be generated to alert to the user that the sensor has detected a flammable or combustible gas.

For the purposes of this application, the term "gas" includes, not only conventional gases, but also aerosols (i.e., aerosolized liquids or solids suspended in air or another gas), sprays, mists, vapors, fumes, and other volatile compounds. This is because these substances behave more like a gas in terms of flow and distribution within a shredder.

Figure 1:
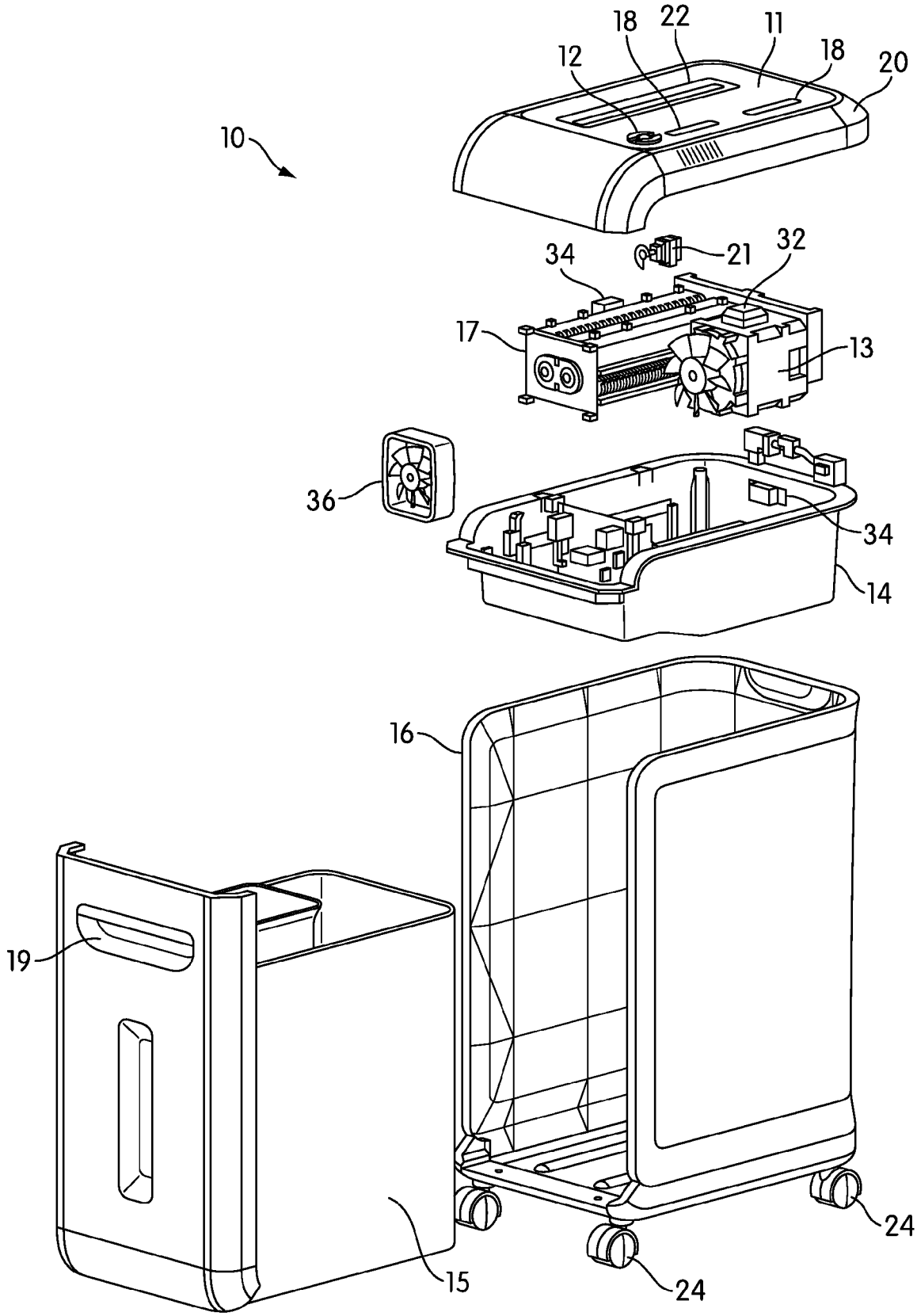
FIG. 1 shows an exploded view of a shredder constructed in accordance with an embodiment.

FIG. 1 shows an exploded view of a shredder constructed in accordance with an embodiment. The shredder is generally indicated at 10. The shredder includes a housing 20 having a throat 22 for receiving at least one article to be shredded, a shredder mechanism 17 received in the housing 20. The shredder mechanism 17 includes the motor 13 and cutter elements. The shredder mechanism 17 enables the at least one article to be shredded to be fed into the cutter elements. The motor 13 is operable to drive the cutter elements so that the cutter elements shred the articles fed therein.

The shredder 10 includes a bottom receptacle 14 having a bottom wall, four side walls and an open top. The bottom receptacle 14 may be molded from a plastic material or any other material. The bottom receptacle 14 sits atop the upper periphery of the bottom housing 16 in a nested relation using flange portions of the bottom receptacle 14 that generally extend outwardly from the side walls thereof. The shredder mechanism 17 along with the motor 13 are configured to be received in the bottom receptacle 14 of the shredder housing 20. The bottom receptacle 14 may be affixed to the underside of the top cover or wall 11 by fasteners. The receptacle 14 has an opening in its bottom wall through which the shredder mechanism 17 discharges shredded articles into the container 15.

As noted above, the shredder 10 includes the shredder mechanism 17 that includes the electrically powered motor 13 and a plurality of cutter elements. The term "shredder mechanism," as used herein, is a generic structural term to denote a device that destroys articles using at least one cutter element. Such destroying may be done in any particular way. For example, the shredder mechanism may include at least one cutter element that is configured to punch a plurality of holes in the document or article in a manner that destroys the document or article. In addition, the term "shredder mechanism" is not intended to be limited to devices that literally "shred" documents and articles, but is instead intended to cover any device that destroys documents and articles in a manner that leaves each document or article illegible and/or useless. In the illustrated embodiment, the cutter elements are generally mounted on a pair of parallel rotating shafts. The motor 13 operates using electrical power to rotatably drive the shafts and the cutter elements through a conventional transmission so that the cutter elements shred articles fed therein. The shredder mechanism 17 may also include a sub-frame for mounting the shafts, the motor 13, and the transmission. The operation and construction of such a shredder mechanism 17 are well known and need not be described herein in detail. Generally, any suitable shredder mechanism 17 known in the art or developed hereafter may be used.

In the illustrated embodiment, the shredder 10 may sit atop the large freestanding housing 16, which may be formed of molded plastic material or any other material. The housing 16 includes a bottom wall, three side walls, an open front and an open top. The side walls of the container 16 provide a seat on which the shredder housing 20 is removably mounted. The housing 16 may be constructed and arranged to receive the waste container 15 therein. In other words, the waste container 15 is enclosed in the housing 16. The waste container 15 is formed of molded plastic material or any other material. The waste container 15 is in the form of a pull-out bin that is constructed and arranged to slide in and out of the housing 16 through an opening in the front side thereof. The waste container 15 includes a handle 19 that may be configured to allow a user to grasp and pull out the waste container 15 from the housing 16. In the illustrated embodiment, the handle 19 is located on the front, side wall of the waste container 15. Any construction or configuration for the housing or waste container 15 may be used, and the illustrated embodiment is not limiting.

As an option, the housing 16, along with the shredder 10, may be transported from one place to another by simply rolling the housing 16 on roller members 24, such as wheels or casters. In the illustrated embodiment, the housing 16 includes two pairs of roller members 24 attached to the bottom of the frame of the housing 16 to support the housing 16. The rolling members 24 can be located on the housing 16 as near the corners as practical. The roller members 24, in one embodiment, may be locked against rolling motion by lock members to provide a stationary configuration. In one embodiment, the front pair of the roller members 24 may be casters that provide a turning capability to the housing 16, while the rear pair of the roller members 24 may be wheels that are fixed in direction, so as to only allow roll in the intended direction of travel.

The cover 11 may include a switch 12 recessed with an opening therethrough. For example, an on/off switch 12 that includes a switch module may be mounted to the top cover 11 underneath the switch recess by fasteners, and a manually engageable portion that moves laterally within the switch recess. The switch module has a movable element that connects to the manually engageable portion through the opening. This enables movement of the manually engageable portion to move the switch module between its states.

The switch module 12 is configured to connect the motor 13 to the power supply. This connection may be direct or indirect, such as via a controller. Typically, the power supply will be a standard power cord with a plug on its end that plugs into a standard alternating current (AC) outlet. The switch 12 may be movable between an "on" position and an "off" position by moving the manually engageable portion laterally within the switch recess. In the "on" position, contacts in the switch module are closed by movement of the manually engageable portion and the movable element to enable a delivery of electrical power to the motor 13. In the "off" position, contacts in the switch module are opened to disable the delivery of electric power to the motor 13. Alternatively, the switch 12 may be coupled to a controller, which in turn controls a relay switch, for controlling the flow of electricity to the motor 13. As an option, the switch 12 may also have a reverse position wherein contacts are closed to enable delivery of electrical power to operate the motor 13 in a reverse manner.

A thickness detector 21 may also be provided that is configured to detect a thickness of the at least one article received by the throat 22. The controller, for example, may be configured to vary the running operation of the motor responsive to the detector detecting the thickness of the at least one article being received by the throat 22. Exemplary thickness detectors are disclosed, for example, in U.S. Patent Application Publication No. 2007/0246585.

According to an aspect of the application, the shredder 10 is provided with a gas detection system. The gas detection system may include a gas detection sensor 32 which is configured to detect a gas within the housing 20. In addition or alternatively, one or more temperature sensors 34 may be provided which are configured to detect a rapid change in temperature of a aerosol spray.

If an aerosol (or other gas) is sprayed into the shredder, the sensor(s) will detect the aerosol gas and the shredder motor 13 may be disabled or deactivated. In addition, the exhaust fan 36 may also be activated to remove the aerosol gas from the housing and/or drawn in ambient air to dilute the gas within the housing.

One or more indicators 18 may provide status to the user of one or features of the shedder, including providing a visible and/or audible alert to the user that the sensor has detected a gas. For example, the display indicators 18 may include one or light emitting diodes (LED), liquid crystal display (LCD), speaker, beeper, gauge, lamp, or other indicating means. Additional information may be provided to the user, such as the gas detected, concentration, action taken, and/or further instructions.

Figure 2:
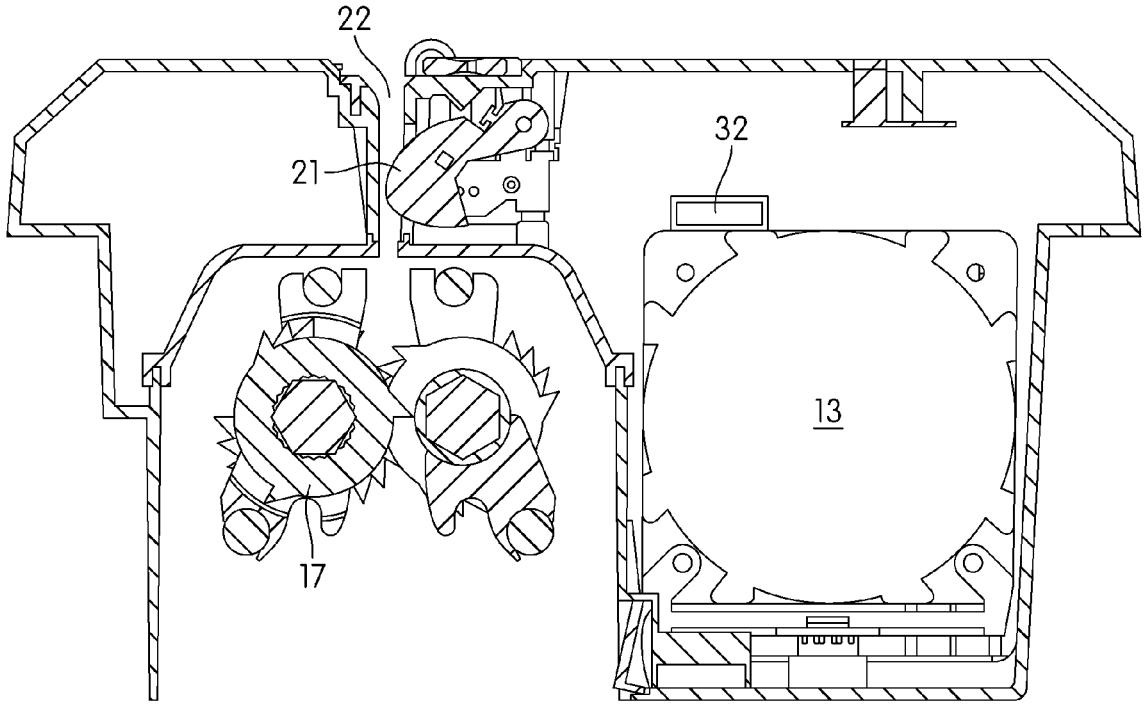
FIG. 2 shows a cross-sectional view of the top portion of the shredder shown in FIG. 1.

FIG. 2 shows a cross-sectional view of the top portion of shredder 10 shown in FIG. 1. The gas detection sensor 32 may be, for example, mounted adjacent to the motor 13. This configuration may help prevent detect gases which could be ignited if the motor 12 were to be switched on. Other locations for the gas detection sensor 32 and temperature sensors 34 are also envisioned in which the presence of gases could be ignited by the electrical activity of the paper shredder (e.g., commutators, switches, relays, exposed contact points, etc.).

Figure 3:
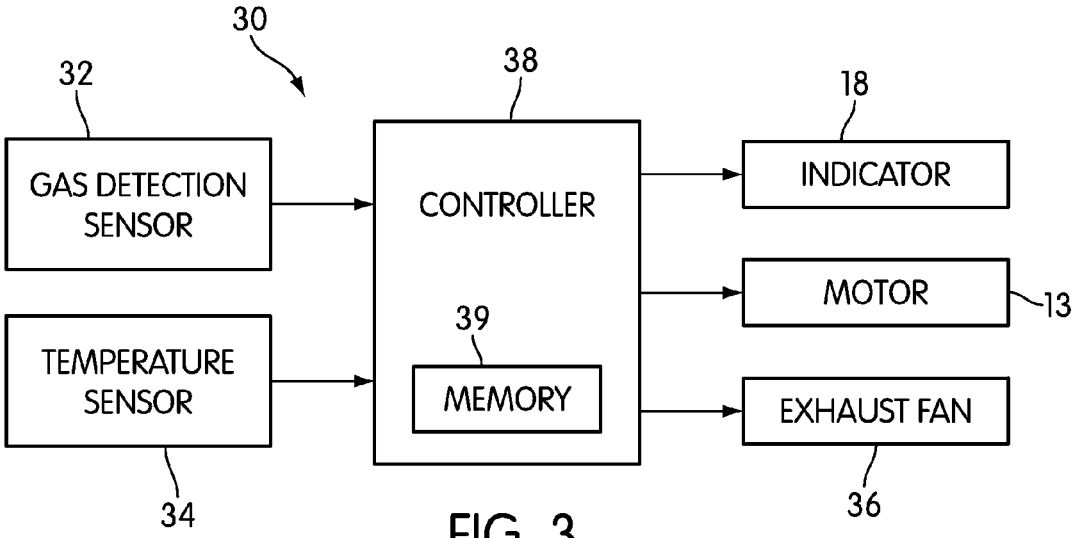
FIG. 3 shows an exemplary gas detection system architecture, in accordance with an embodiment.

FIG. 3 shows an exemplary gas detector system architecture 30 in accordance, with an embodiment.

The gas detection system architecture 30 may include a gas detection sensor 32. The gas detection sensor 32 may be configured to detect gases, and in particular, flammable and/or combustible gases. For example, detected gases may include, but are not necessarily limited to: hydrocarbons (such as propane, n-butane, iso-butane, etc.), chlorofluorocarbons (CFCs), dimethyl ether, methyl ethyl ether, nitrous oxide, diflourethane, and carbon dioxide. The gas detection sensor 32 may also be configured to detect volatile compounds, including solvents.

It will be appreciated that the gas detection sensor 32 may use various gas detection sensor technologies, such as, for example, solid state. pellistor, catalyst, and ionization. In one implementation, the gas detection sensor 32 may be a model TGS 832 manufactured by Figaro USA Inc. The gas detection sensor 32 could also be a model CH-D3 manufactured by Alphasense Ltd. (UK)

Multiple gas detection sensors 32 might be positioned at different locations in the shredder 10 and/or configured for detecting different gases.

In addition or as an alternative to the gas detection sensor 32, one or more temperature sensors 34 may be provided for detecting a gas. Typically, gases are stored are under great pressure in their containers. When sprayed, there may be a rapid temperature change due to the expansion of the gas. The temperature sensor 34, thus may be configured to detect a temperature change associated with the expanding gas.

In one implementation, the temperature sensor(s) 34 may be a model LM35CZ manufactured by National Semiconductor Corporation. This is a linear output temperature sensor. In addition to solid state sensors, thermistors could be used (i.e., a resistor whose properties change with temperature). One example of a thermistor that may be used is Part Number 103JG1J manufactured by US Sensor Corp.

The temperature sensors 34 may be provided at various location in the shredder housing 20 where a gas is likely to be sprayed (e.g., throat, vents, particle exit, etc.). If desired, one or more temperature sensors 34 may be placed inside the housing 20 away from any openings.

A gas detector controller 38 may also be provide for processing the signals generated from the gas sensor 32 and/or the temperature sensor(s) 34, and controlling various aspects of the shedder. The gas detector controller 38 may include an electrical circuit, integrated circuit, discrete circuit, microprocessor, and/or software (firmware).

The controller 38 may be connected to the shredder motor 13, one or more indicators 18, and exhaust fan 36. Based on the feedback from the sensors, the controller 38 may disable the shredder motor 13 and/or enable the exhaust fan 36. Alternatively or additionally, the indicator 18 may be activated.

FIG. 1, for example, shows the shredder 10 having two temperature sensors 34. This configuration allows the temperature changes in the shredder 10 to be monitored by the two temperature sensors 34. In one implementation, if a sudden change is detected by one temperature sensor 34, the motor 13 may be deactivated for a predetermined amount of time while the exhaust fan 36 is activated.

In some embodiments, the controller 38 may be capable of not only detecting a gas, but determining the particular gas (or gases) detected, and its concentration. Depending on the gas and concentration, different alerts, and/or exhausting procedures may be implemented.

In addition, the controller 38 may include a memory device 39 to collect and store metric data for investigative purposes. For example, the stored information, may include, the number of times each sensor was activated, the particular gases that were detected, concentrations, time to exhaust, and/or alert actions taken. The user may be able to use the indicator 18 to view the metric data stored in the memory device 39. In addition, the metric data may be retrieved by service personnel.

The controller 38 may in some embodiments may be integrated with other functionalities of the shredder, although it will be appreciated that the controller 38 may be stand alone.

Figure 4:
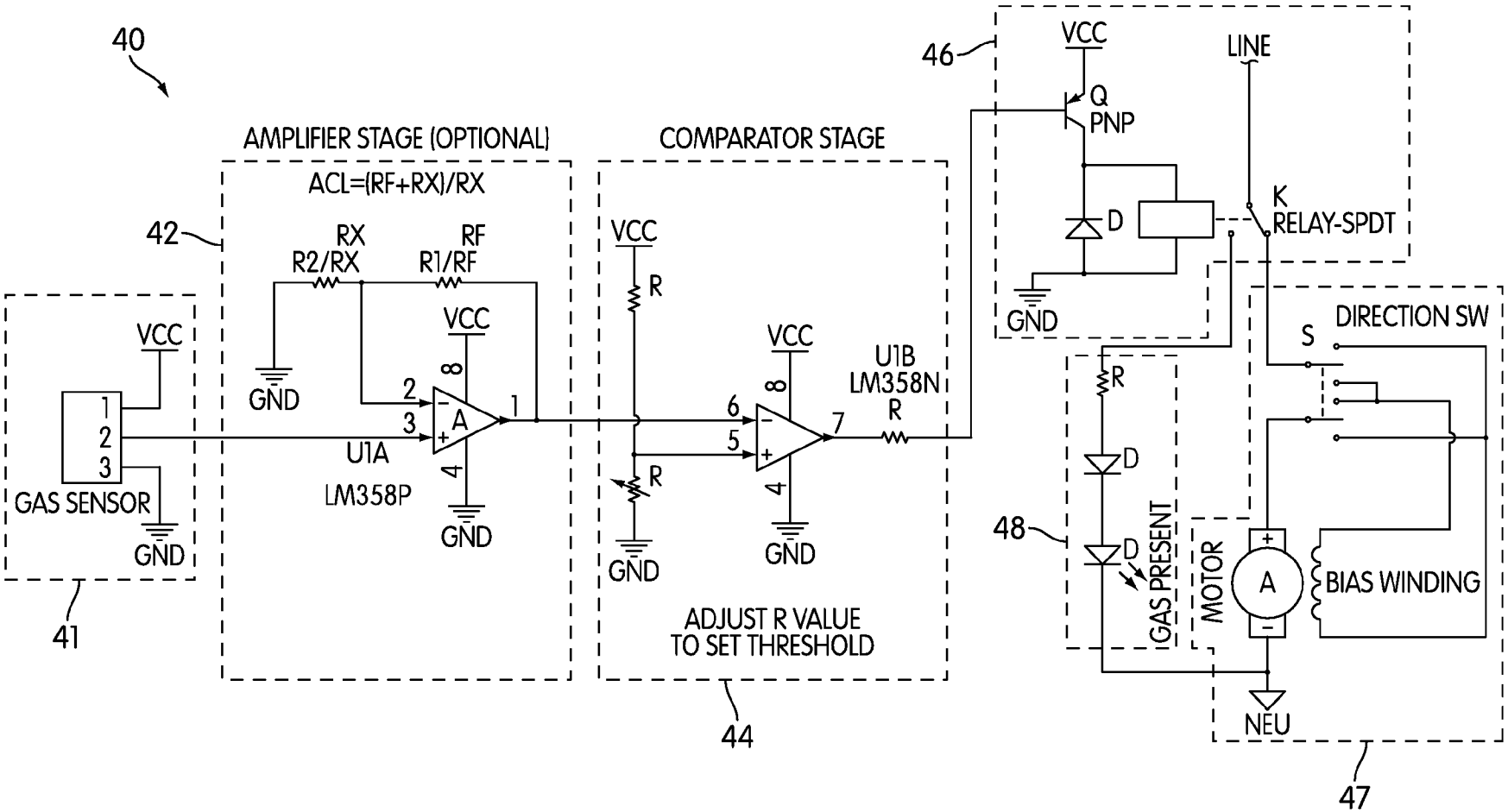
FIG. 4 shows an exemplary circuit schematic of a gas detection system for a shredder, in accordance with an embodiment.

FIG. 4 shows an exemplary circuit schematic 40 for a gas detection system for a shredder, in accordance with an embodiment of the application.

The output of the gas detection sensor circuit 41 may be provided to an optional amplifier stage 42 to increase the gain of the voltage output of the gas detection sensor. The output signal may then be provided to a comparator stage 44. The comparator stage 44 compares the output voltage of the sensor (or amplified voltage) to a threshold voltage. The threshold voltage may be set so as to distinguish the gas detected from mere noise. A potentiometer, for example, may be provided in the comparator stage 44 for manual adjustment of the voltage.

If the output voltage is greater than the threshold voltage, a relay circuit 46 may be switched which cuts off current to the shredder motor circuit 47. Thus, even if the user attempts to operate the shredder (including turning the power switch 12 to the "on" position), the shredder mechanism will simply not operate. In addition, the relay switches current flow through a light emitting diode (LED) indicator circuit 48 to indicate the presence of a gas to the user. Further alerts may indicate to the user that a dangerous condition may be present.

When the output of the gas detection sensor circuit 41 falls below the threshold voltage, the relay circuit 46 may be switched to permit current to flow to the shredder motor circuit 47, rather than the LED indicator 48. As such, the user may again be able to operate the shredder.

Figure 5:
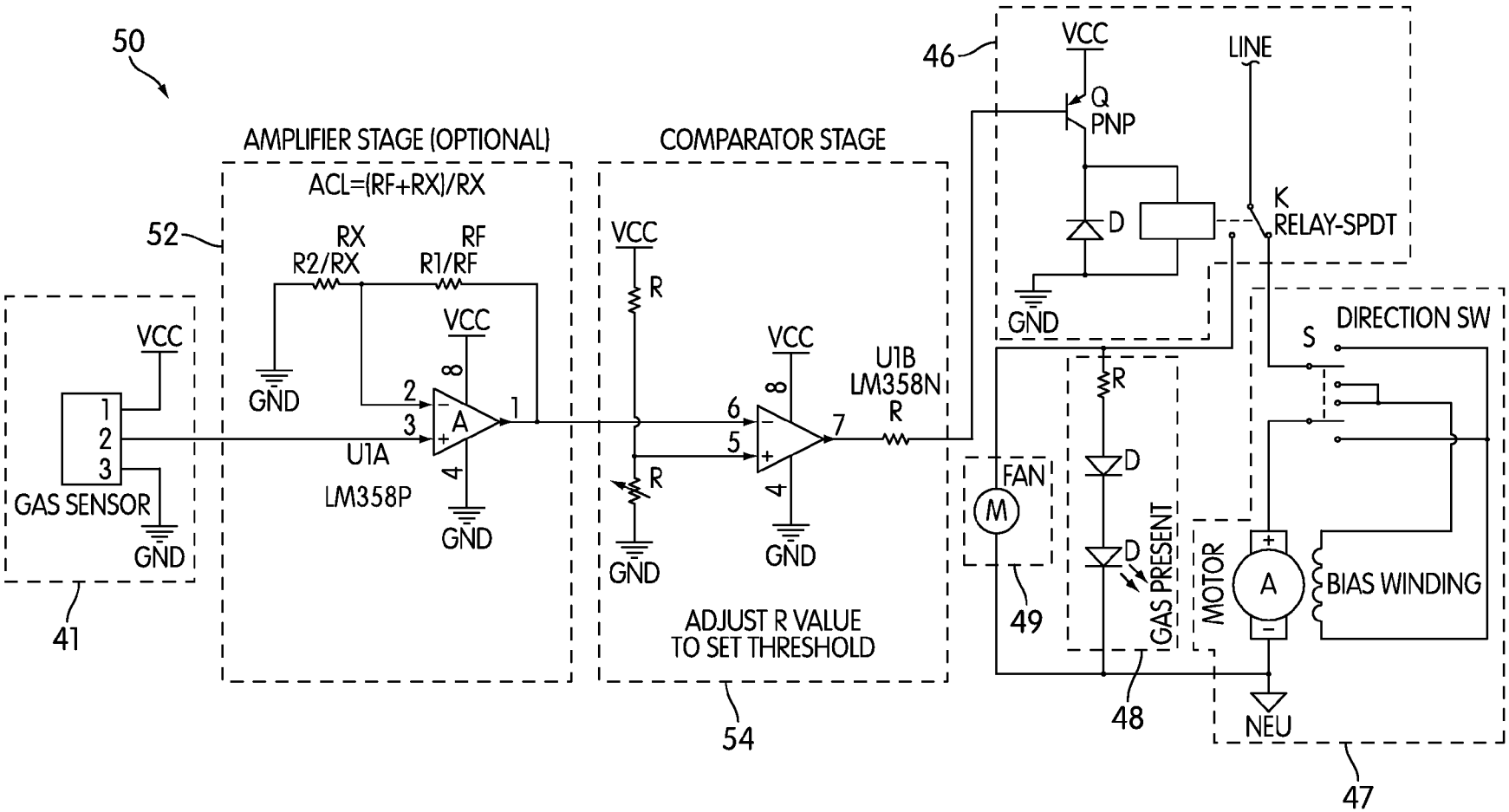
FIG. 5 shows another exemplary circuit schematic of a gas detection system for a shredder, in accordance with an embodiment.

FIG. 5 shows another exemplary circuit schematic 50 for the gas detection control system for a shredder, in accordance with an embodiment.

This circuit 50 may be similar to the circuit 40 shown in FIG. 4, with the addition of an exhaust fan circuit 49. The exhaust fan circuit 49 may be energized to operate when the motor circuit 47 is deactivated. The exhaust fan circuit 49 may purge or quickly remove the aerosol gas from within the housing of the shredder assembly. In some implementations, the fan might also draw ambient air into the shredder housing to reduce/dilute the concentration of gas therein.

Figure 6:
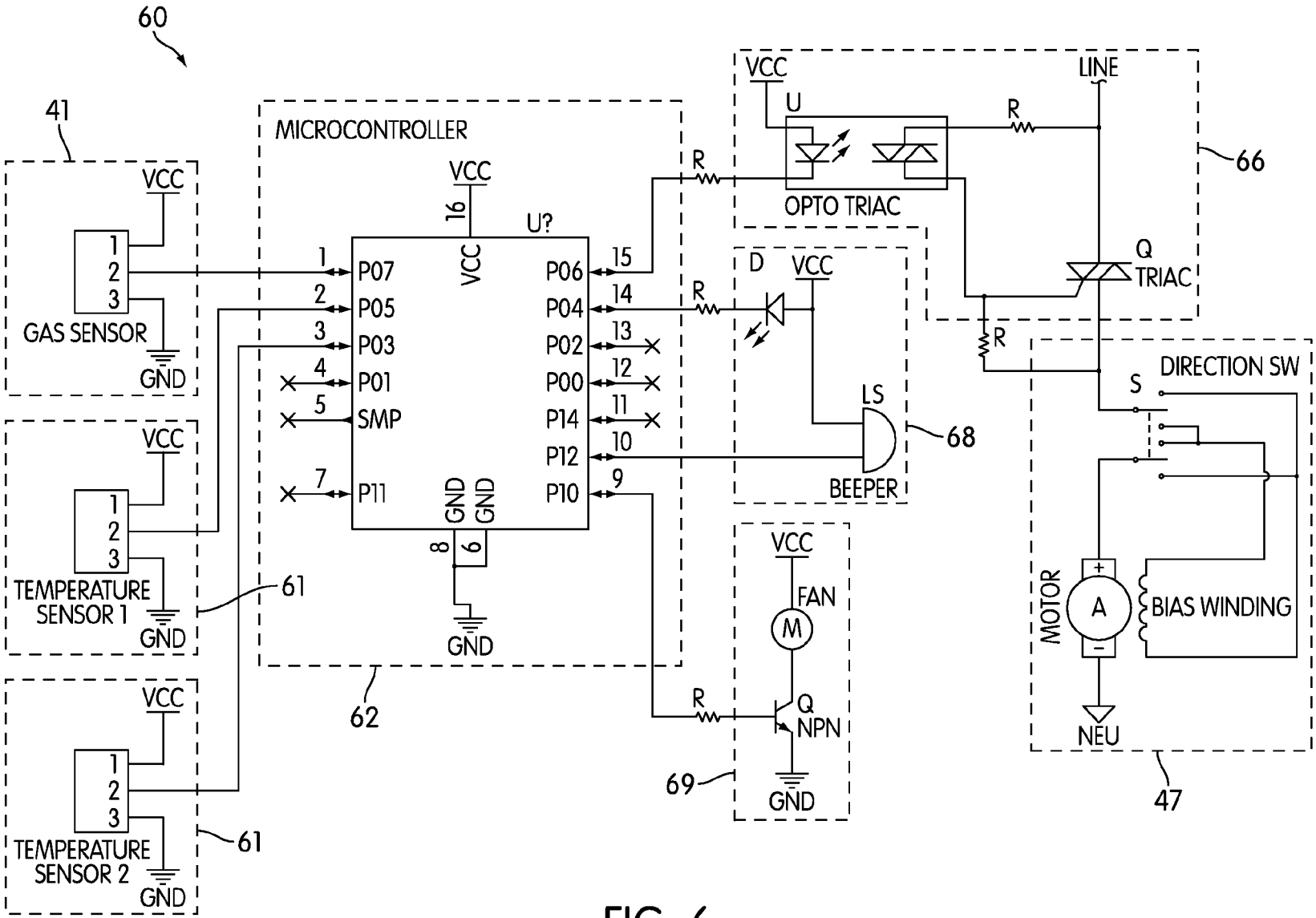
FIG. 6 shows yet another exemplary circuit schematic of a gas detection system for a shredder, in accordance with an embodiment.

FIG. 6 shows yet another an exemplary circuit schematic 60 for the gas detection control system for a shredder, in accordance with an embodiment.

This circuit 60 includes a gas detection sensor circuit 41, two temperature sensor circuits 61, a microprocessor 62, an exhaust fan circuit 69 36, indicator circuit 68, and a shredder motor circuit 47. The microprocessor may be an 8051 based core or ARM core processor. In one implementation, the microprocessor may be a model CY8C21534 manufactured by Cypress Semiconductor Corp.

The microcontroller 62 receives signals from the gas detection sensor circuit 41 and/or the temperature sensor circuits 61 for analysis. The microcontroller 62 may be configured to determine one or more particular gases, and concentrations.

Based on the feedback from the sensors, the microcontroller 62 may deactivate the shredder motor circuit 47. For example, output from the microcontroller 62 may be feed to a switch circuit 66 (such as a Triac) to control current to the shredder motor circuit 47. Other solid-state switching circuits and mechanisms may similarly be used.

The microcontroller 62 may individually control the motor circuit 47, the exhaust fan circuit 69 and the indicator circuit 68 In one implementation, the indicator circuit 68 may include a beeper (or speaker) for emitting an audible signal, in additional to a LED. Other types of indicators are also possible.

The above embodiments are primarily directed to shredders. However, the gas sensing systems disclosed herein may also be adapted for various other applications which have electrically powered motors (e.g., brushed DC motors or universal motors) or heat sources, in which there may be a potential for flash events. This may include most power tools (such as saws and drills), binding and laminating machines, household appliances, vacuum cleaners, hair dryers, etc. Other applications may also be benefited.

While this disclosure has been described in connection with what is presently considered to be the most practical embodiment, it is to be understood that it is capable of further modifications and is not to be limited to the disclosed embodiment, and this application is intended to cover any variations, uses, equivalent arrangements or adaptations of the disclosure following, in general, the principles of the disclosure and including such departures from the present disclosure as come within known or customary practice in the art to which the disclosure pertains, and as may be applied to the essential features hereinbefore set forth and followed in the spirit and scope of the appended claims.

What is claimed is:

1. A document shredder for home or office use comprising:

a housing including an elongated throat for receiving one or more sheets of paper and a shredder mechanism configured to shred the article received, the shredder mechanism comprising an electrically powered motor and a set of interleaving cutters, at least one of which is rotatable by the motor, the cutters being arranged parallel to and in alignment with the throat;

a combustible gas detection system positioned inside the housing and configured to detect a combustible gas which has been externally sprayed into the housing, through the throat, separate from any article to be shred; and a controller coupled to the combustible detection system and configured to deactivate the motor of the shredder mechanism in response to the combustible gas detection system detecting the combustible gas within the housing.

2. The shredder according to claim 1, further comprising:

a fan configured to exhaust the housing of gas and/or to draw ambient air into the housing to dilute gas therein.

3. The shredder according to claim 1, wherein the gas detection system comprises:

a gas detection sensor configured to detect a particular gas.

4. The shredder according to claim 3, wherein the gas detection sensor is mounted adjacent to the motor.

5. The shredder according to claim 3, wherein the gas detection sensor is configured to detect one of more of: hydrocarbons, propane, n-butane, iso-butane, chlorofluorocarbons (CFCs), dimethyl ether, methyl ethyl ether, nitrous oxide, diflourethane, and/or carbon dioxide.

6. The shredder according to claim 1, wherein the gas detection system comprises:

at least one temperature sensor configured to detect a temperature change due to the expansion of a pressurized gas.

7. The shredder according to claim 6, wherein the one or more temperature sensors are located inside the housing away from any openings.

8. The shredder according to claim 1, further comprising:

an indicator to alert the user of the presence of a gas.

9. The shredder according to claim 8, wherein the indicator is configured to generate: a visible alert, an audible alert, or both.

10. The shredder according to claim 1, wherein the controller includes a memory device configured to store metric information related to detected gas.

11. The shredder according to claim 1, wherein the controller is configured to deactivate the motor for a predetermined amount of time.

12. The shredder according to claim 1, wherein the controller is configured to determine a concentration of a detected gas.

13. A method for shredding using a document shredder for home or office use, the method comprising:

receiving an article via an elongated throat of the shredder for receiving one or more sheets of paper;

shredding the article received using a shredder mechanism of the shredder having an electrically powered motor and a set of interleaving cutters, at least one of which is rotatable by the motor, the cutters being arranged parallel to and in alignment with the throat;

detecting, with a gas sensor, a combustible gas which has been externally sprayed into the housing, through the throat, separate from any article to be shred; and deactivating the motor of the shredder mechanism upon detecting the combustible gas.

14. The method according to claim 13, further comprising:

exhausting a housing of the shredder of gas and/or drawing ambient air into the housing to dilute gas therein.

15. The method according to claim 13, wherein detecting comprises:

detecting a particular gas.

16. The method according to claim 13, wherein detecting comprises:

detecting a temperature change due to the expansion of a pressurized gas.

17. The method according to claim 13, further comprising:

generating an alert to indicate to the user the presence of a gas.

18. The method according to claim 13, further comprising:

storing in a memory device metric information related to detected gas.

19. The method according to claim 13, wherein deactivating comprises:

deactivating the motor for a predetermined amount of time.

20. The method according to claim 13, wherein detecting comprises:

determining a concentration of a detected gas.

* * * * *